US012110885B2

(12) United States Patent
Rhyner

(10) Patent No.: US 12,110,885 B2
(45) Date of Patent: Oct. 8, 2024

(54) SEAL SUPPORT SENSOR FOR A PUMP

(71) Applicant: Eddy Pump Corporation, El Cajon, CA (US)

(72) Inventor: Phillip Rhyner, El Cajon, CA (US)

(73) Assignee: EDDY PUMP CORPORATION, El Cajon, CA (US)

( * ) Notice: Subject to any disclaimer, the term of this patent is extended or adjusted under 35 U.S.C. 154(b) by 151 days.

(21) Appl. No.: 16/804,456

(22) Filed: Feb. 28, 2020

(65) Prior Publication Data

US 2020/0277950 A1 Sep. 3, 2020

Related U.S. Application Data

(60) Provisional application No. 62/811,745, filed on Feb. 28, 2019.

(51) Int. Cl.
*F04B 51/00* (2006.01)

(52) U.S. Cl.
CPC ..... *F04B 51/00* (2013.01); *F04B 2205/09* (2013.01)

(58) Field of Classification Search
CPC ..... F04B 51/00; F04B 2205/09; G01F 23/74; G01F 23/268; G01F 23/2962
See application file for complete search history.

(56) References Cited

U.S. PATENT DOCUMENTS 5,484,267 A * 1/1996 Rockwood ..... F16J 15/3404 417/372
5,929,754 A * 7/1999 Park ..... G01F 23/263 73/304 C
2005/0236307 A1* 10/2005 Mazurek ..... B01D 17/0214 210/86
2005/0268715 A1* 12/2005 Sabatino ..... G01F 23/74 73/313
2010/0073123 A1* 3/2010 Craddock ..... G01L 19/0069 73/725
2010/0307236 A1* 12/2010 Giordano ..... G01D 18/008 73/299
2011/0203370 A1* 8/2011 Argov ..... E03F 7/12 73/438
2011/0270542 A1* 11/2011 Chappell ..... G01F 23/268 702/55
2013/0220012 A1* 8/2013 Knowles ..... G01F 23/2967 73/290 V
2015/0013646 A1* 1/2015 Qi ..... G01F 23/2962 123/478
2015/0185909 A1* 7/2015 Gecnuk ..... G06F 1/324 345/174

* cited by examiner

*Primary Examiner* — Connor J Tremarche
(74) *Attorney, Agent, or Firm* — GLOBAL IP COUNSELORS, LLP

(57) ABSTRACT

A seal support sensor includes a housing, an extension, a sensor and an electronic controller. The housing is configured to attach to a barrier fluid tank. The extension 64 has a distal end and a proximal end, the proximal end being connected to the housing. The sensor is disposed at the distal end, configured to be disposed within the barrier fluid tank and configured to detect a parameter within the barrier fluid tank. The electronic controller is configured to determine whether the parameter within the barrier fluid tank is within a predetermined range perform a mitigation operation when the parameter is not within the predetermined range.

12 Claims, 11 Drawing Sheets

SEAL SUPPORT SENSOR FOR A PUMP

CROSS-REFERENCE TO RELATED APPLICATION

This application claims benefit of U.S. Provisional Application No. 62/811,745, filed Feb. 28, 2019, the contents of which are hereby incorporated herein by reference.

BACKGROUND

Field of the Invention

The present invention generally relates to a seal support sensor. More specifically, the present invention relates to a seal support sensor configured to improve seal performance and life for a pump.

Background Information

Conventional pump monitoring is most often effected by a person who periodically visits each pump, makes observations of noise and leaks and takes vibration readings with instrumentation utilizing an accelerometer. The information is compared with historical data on that pump to detect trends that could result in failure of the pump bearings, couplings or seals.

Moreover, in some conventional systems detectors can be used, whether permanently installed or periodically applied by an operator, which generally monitor the bearings or couplings, either directly or through the housing and do not indicate the condition of the seal, which can indicate failures in other components of the pump.

SUMMARY

It has been discovered that the reliability of mechanical seals can be improved with precise control of barrier fluid environmental factors. In view of the state of the known technology, one aspect of the present disclosure is to provide a seal support sensor that includes a housing, an extension 64, a sensor and an electronic controller. The housing is configured to attach to a barrier fluid tank. The extension 64 has a distal end and a proximal end, the proximal end being connected to the housing. The sensor is disposed at the distal end, configured to be disposed within the barrier fluid tank and configured to detect a parameter within the barrier fluid tank. The electronic controller is configured to determine whether the parameter within the barrier fluid tank is within a predetermined range perform a mitigation operation when the parameter is not within the predetermined range.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
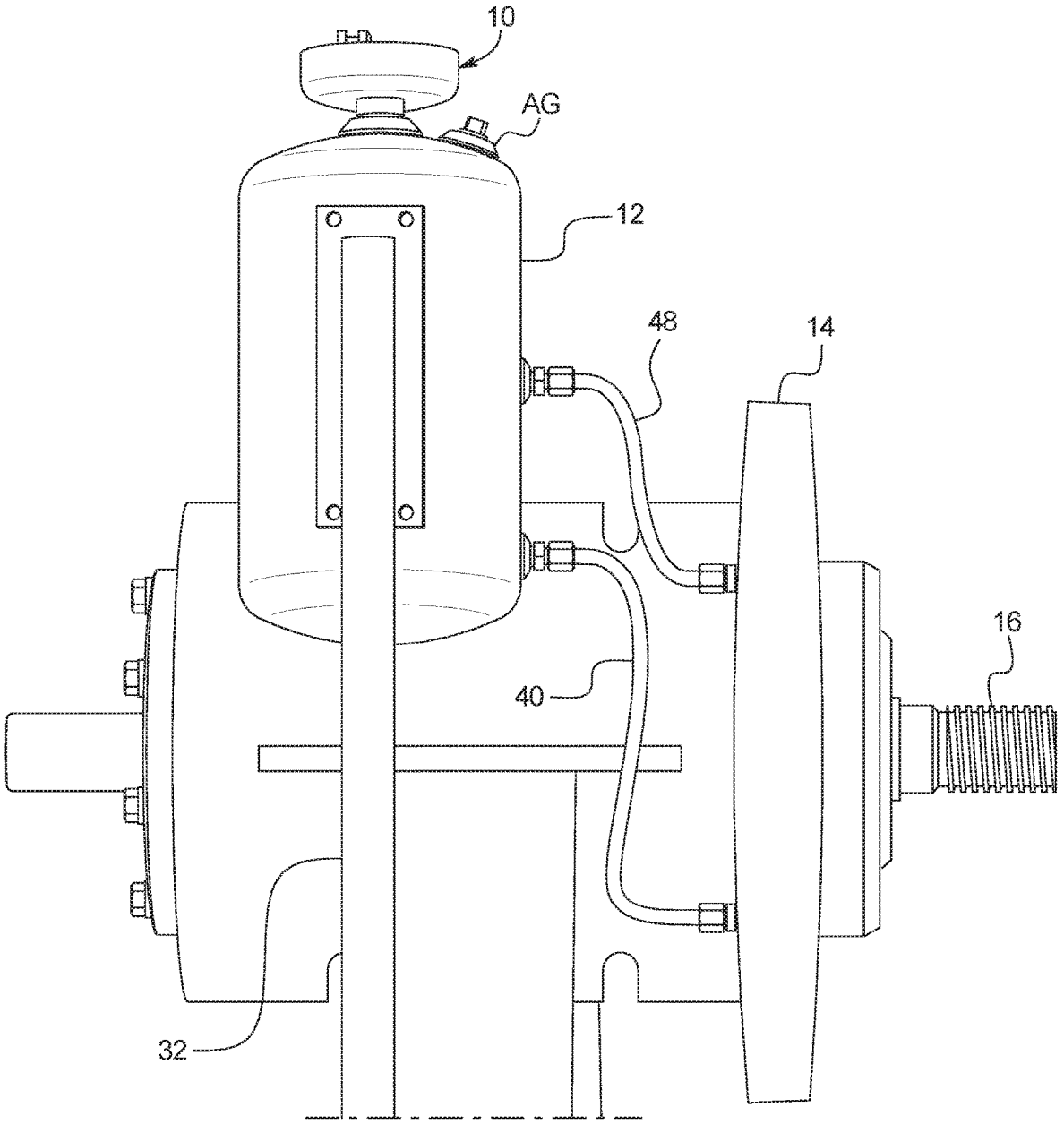
FIG. 1 is a side elevational view of a seal support sensor according to an embodiment of the present invention disposed within a barrier fluid tank for pump shaft seal.
Figure 2:
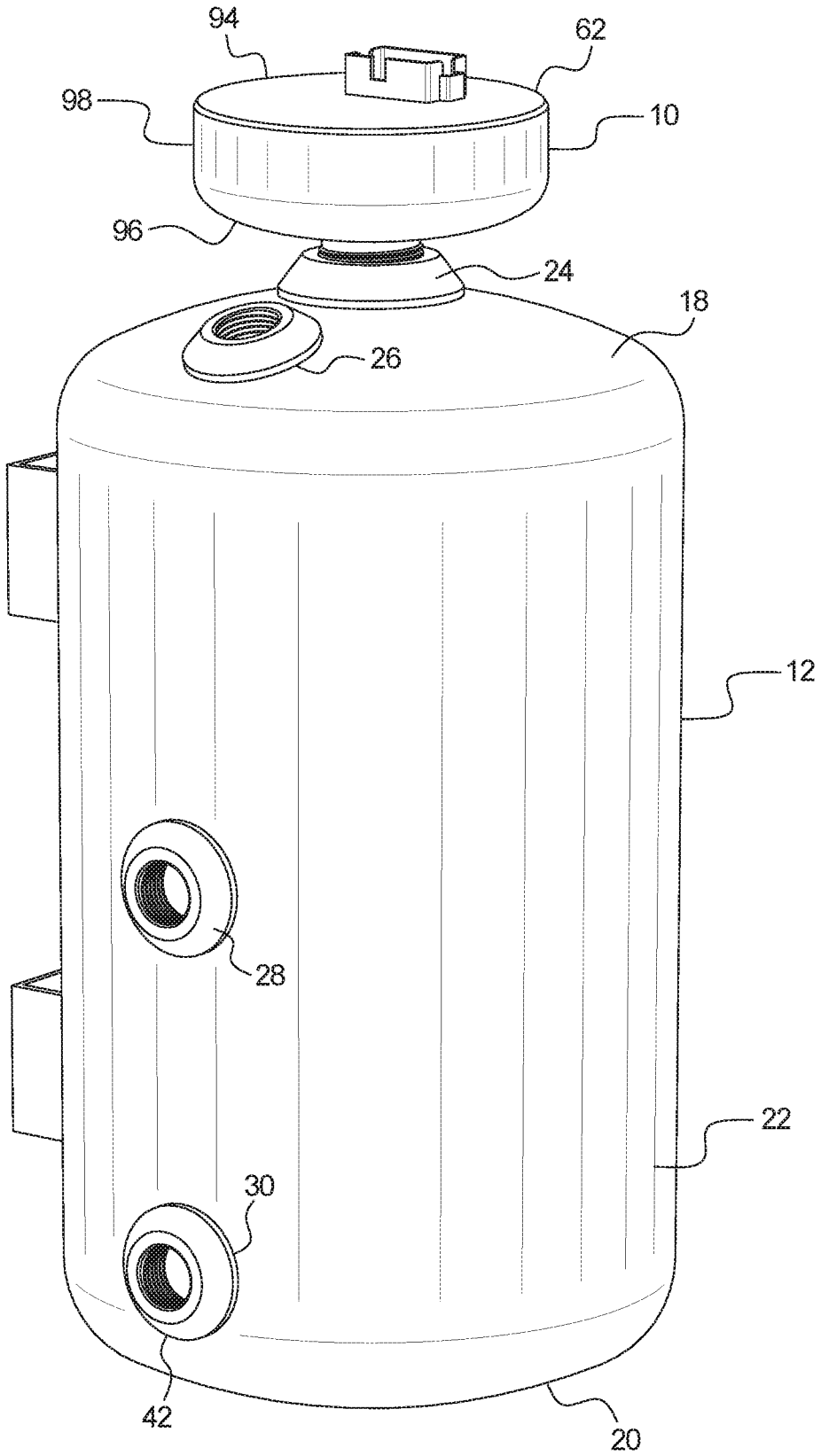
FIG. 2 is a top perspective view of the seal support sensor of FIG. 2 disposed within the barrier fluid tank.
Figure 3:
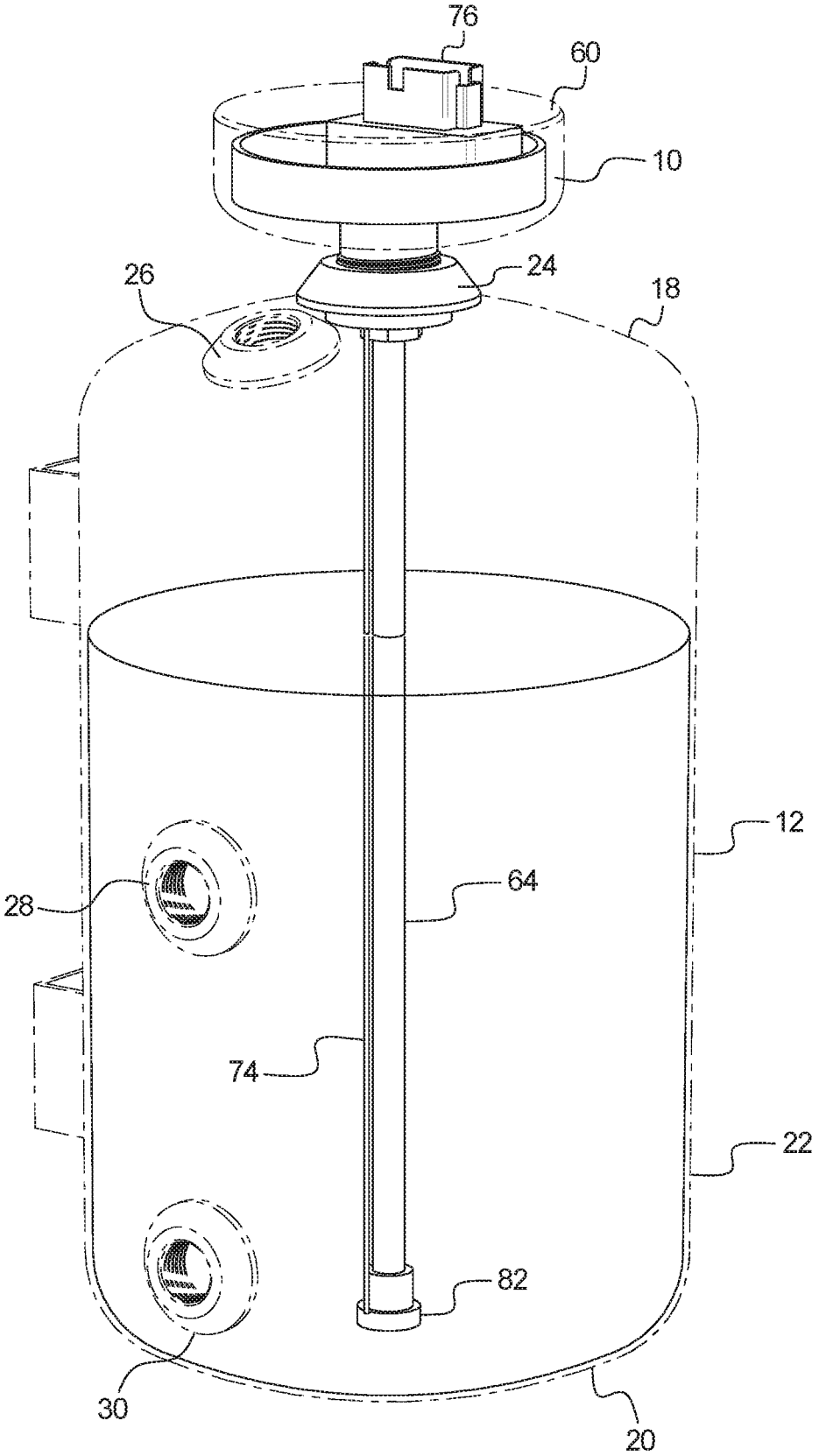
FIG. 3 is a top perspective view of FIG. 2 with the barrier fluid tank and the housing in phantom.

FIG. 1 illustrates an embodiment of the present invention directed to a seal support sensor 10 that is disposed within a barrier fluid tank 12 for pump shaft seal 14. As can be understood, the pump can be any conventional pump that includes a pump shaft 16, a pump shaft seal 14, an impeller (not shown) and a volute (not shown).

As shown in FIGS. 2-5, the barrier fluid tank 12 is preferably a metal or composite tank and can be a generally cylindrical tank with a top surface 18, a bottom surface 20 and a radial surface 22 disposed between the top surface 18 and the bottom surface 20, and is in fluid communication with the pump shaft seal 14. The barrier fluid tank 12 includes a first top port 24, a second top port 26, a middle port 28 and a bottom port 30. As shown in FIG. 1, the barrier fluid tank 12 can be positioned adjacent the pump shaft seal 14 and attached to an attachment post 32 or other structure. It is noted that the barrier fluid tank 12 can be positioned adjacent to the pump shaft seal 14 in any suitable manner. In one embodiment, the barrier fluid tank 12 can be positioned separate from the pump shaft seal 14 and in another embodiment, the barrier fluid tank 12 can be attached to or formed with the pump shaft seal 14. It is further noted that the barrier fluid tank 12 can be formed from any suitable material and have any suitable configuration.

The second top port 26 can be disposed in the top surface 18 offset from the longitudinal center line L of the barrier fluid tank 12 and is a fill/service port and can include an analog gauge AG if desired (FIG. 1). The second top port 26 includes a cylindrical collar 34 that can be press fitted into an opening in the barrier fluid tank 12, or connect to the barrier fluid tank 12 in any suitable permanent, semi-permanent or detachable manner. The collar 34 is generally cylindrical and has a through passage 36 with internal threads 38. The internal threads 38 are configured to couple to the analog gauge.

The bottom port 30 can be disposed in the radial surface 22 and is a seal supply port and is connected to the pump shaft seal 14 through a hose or a tube 40. The bottom port 30 includes a cylindrical collar 42 that can be press fitted into an opening in the barrier fluid tank 12, or connect to the barrier fluid tank 12 in any suitable permanent, semi-permanent or detachable manner. The collar 42 is generally cylindrical and has a through passage 44 with internal threads 46. The internal threads 46 are configured to couple to the hose 40. The pump shaft seal 14 can supply fluid F to the barrier fluid tank 12 through the hose 40 and the bottom port 30.

The middle port 28 can be disposed in the radial surface 22 and is a seal return port and is connected to the pump shaft seal 14 through a hose or a tube 48. The middle port 28 includes a cylindrical collar 50 that can be press fitted into an opening in the barrier fluid tank 12, or connect to the barrier fluid tank 12 in any suitable permanent, semi-permanent or detachable manner. The collar 50 is generally cylindrical and has a through passage 52 with internal threads 54. The barrier fluid tank 12 can return fluid to the pump shaft seal 14 through the hose 48 and the middle port 28.

It is noted that the second top port 26, the middle port 28 and the bottom port 30 can be disposed in any suitable position and are not limited in position and or arrangement as described herein.

The first top port 24 is preferably centrally disposed in the top surface 18 so as to be positioned along the longitudinal center line L of the barrier fluid tank 12. The first top port 24 includes a cylindrical collar 56 that can be press fitted into an opening in the barrier fluid tank 12, or connect to the barrier fluid tank 12 in any suitable permanent, semi-permanent or detachable manner. The collar 56 is generally cylindrical and has a through passage 58 with internal threads 60. The internal threads 60 are preferably female threads that are configured to couple to the seal support sensor 10. However, it is noted that the first top port 24 can be positioned on the barrier fluid tank 12 in any position desired and attach to the seal support sensor 10 in any manner desired.

As shown in FIGS. 2-4A, the seal support sensor 10 is configured to be disposed within the first top port 24 and includes a housing 62, an extension 64, a first sensor 66, a second sensor 68, an electronic controller 70, a wireless communication system 72, a capacitive level sensing probe 74, a multi-pole connector 76, an electrically insulated grounding plate 78, a display 80 and a sealed cap 82.

The housing 62 is preferably molded plastic, but can be formed from any suitable material. The housing 62 is preferably a two piece housing 62 with an upper housing section 62*a* and a lower housing section 62*b* defining a hollow interior 84 which can house a control board 86. The upper and lower housing sections 62*a* and 62*b* are coupled together to form housing 62. When coupled together, as seal or sealing element 88 is disposed between an outer surface or an internal projection 90 of the upper housing section 62*a* and an interior surface 92 of the lower housing section 62*b*, such that the housing 62 is sealed from external elements and the hollow interior 84 is protected. The upper and lower housing sections 62*a* and 62*b* can form the housing 62 that can be generally cylindrical with a top surface 94, a bottom surface 96 and a radial surface 98 therebetween.

The control board 86 includes the electronic controller 70 and other electrical circuitry and components as discussed herein. Moreover, disposed within an opening in the top surface of the housing 62 is the multi-pole connector 76. In one embodiment, the multi-pole connector 76 attached to the housing 62 and configured to enable connection to test equipment. The multi-pole connector 76 can be a M12 5 pin or 8 pin Deustch user connection. Thus, as can be understood, a user can connect test equipment to the multi-pole connector 76 and determine the status of the pump shaft seal 14 without removing the seal support sensor 10.

Figure 4A:
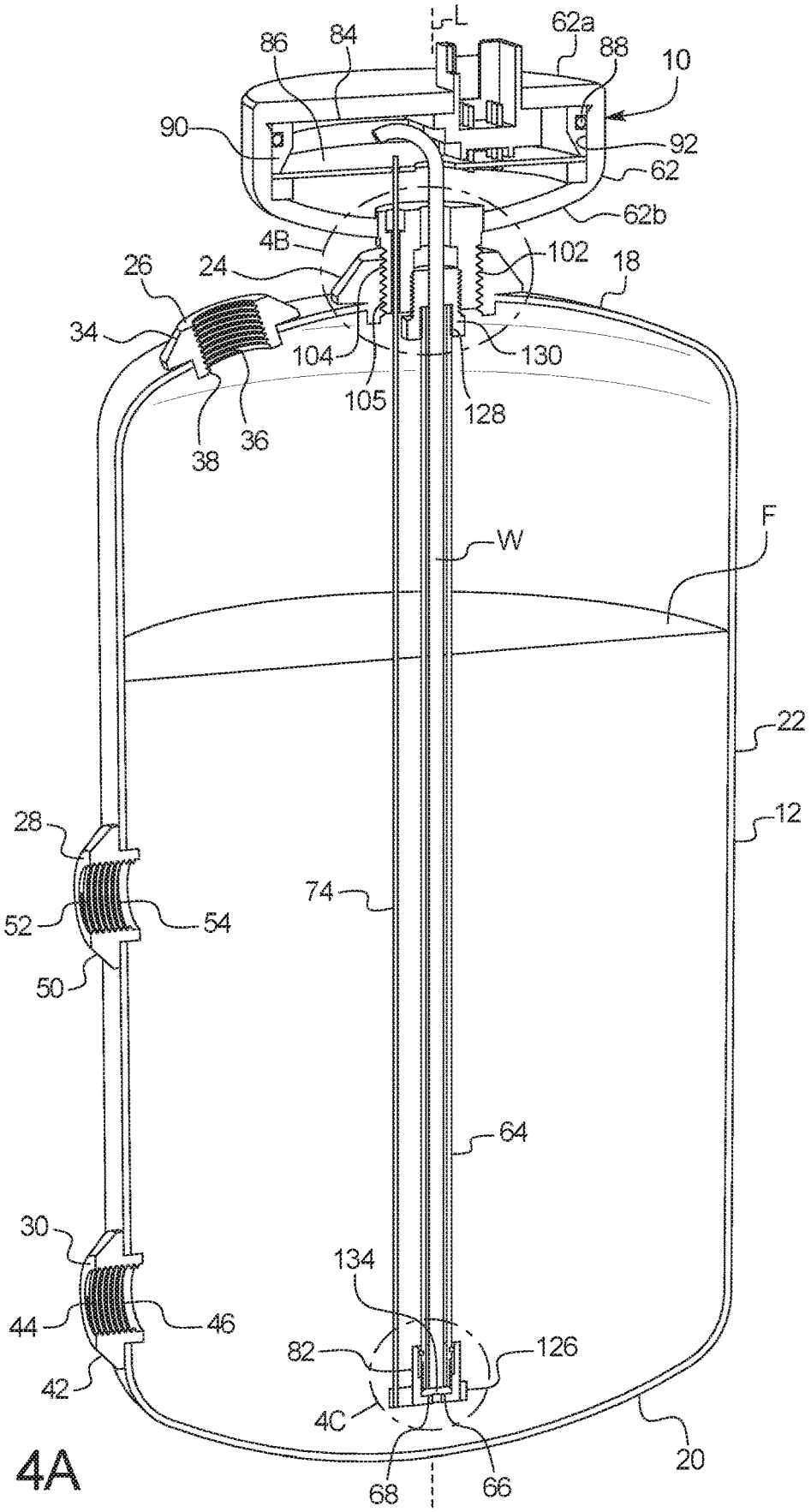
FIG. 4A is a cross sectional view in part of the seal support sensor according to of FIG. 2 disposed within the barrier fluid tank.
Figure 4B:
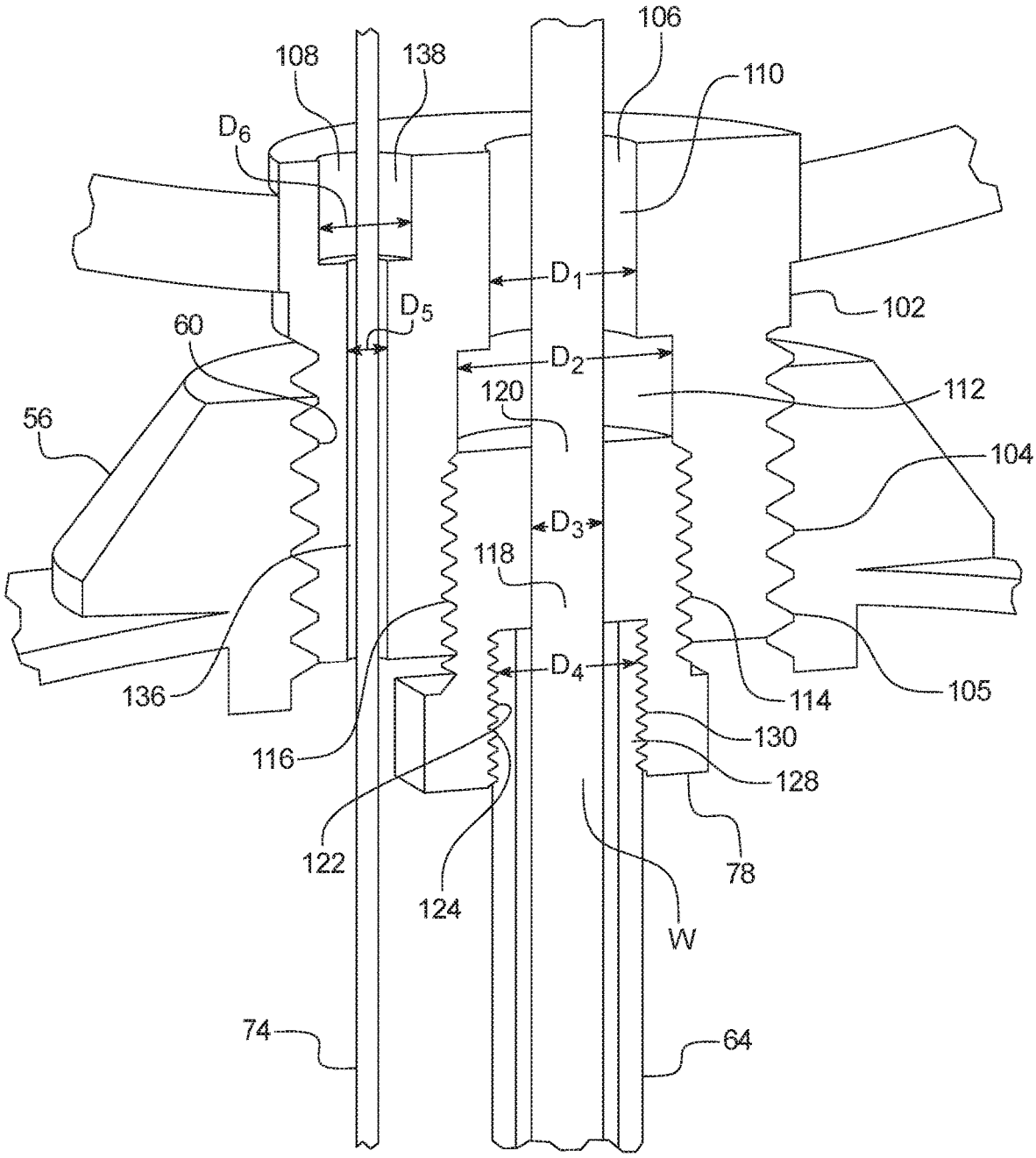
FIG. 4B is an enlarged view in section of the seal support sensor connection to the barrier fluid tank.

As shown in FIGS. 4A and 4B, the housing 62 includes an adapter 102 that preferably is press fitted (e.g., a pressure fitting adapter) into an opening in the bottom surface 96 of the housing 62. The adapter 102 is preferably cylindrical in shape and is molded plastic. The exterior surface 104 of the adapter 102 can have male threads 105 that enable the adapter 102 and thus the housing 62 to be detachably or removably attached to the barrier fluid tank 12. That is, the male threads on the adapter 102 can engage the female threads 60 in the collar 56 of the first top port 24 of the barrier fluid tank 12.

As shown in FIG. 4B, the adapter 102 can include a first longitudinal passage 106 and a second longitudinal passage 108. The first longitudinal passage 108 has a first section 110 and a second section 112, the second section 112 having a diameter $D_2$ that is larger than the diameter $D_1$ of the first section 110. The first longitudinal passage 106 is sized and configured to enable electrical wiring to pass therethrough and along the extension 64 to the sealed cap 82. The second section 112 includes internal or female threads 114 that couple to the electrically insulated grounding plate 78.

The electrically insulated grounding plate 78 is preferably plastic and is generally cylindrical. The electrically insulated ground plate 78 includes external threads 116 that enable the electrically insulated grounding plate 78 to couple to the adapter 102. That is, the male threads 116 on the electrically insulated grounding plate 78 can engage the female threads 114 in adapter 102. The electrically insulated grounding plate 78 can include a first longitudinal passage 118 and a second longitudinal passage 120. The first longitudinal passage 118 has a first section 120 and a second section 122, the second section 122 having a diameter $D_4$ that is larger than the diameter $D_3$ of the first section 120. The first longitudinal passage 118 is sized and configured to enable electrical wiring to pass therethrough and along the extension 64 to the sealed cap 82. The second section 122 includes internal threads 124 that couple to the extension 64. Thus, the an electrically insulated grounding plate 78 is connected to the adapter 102 and is attached to the extension 64.

As shown in FIGS. 4A and 4B, the extension 64 is a cylindrical metal tube that has a distal end 126 and a proximal end 128. The proximal end 128 has external thread 130 that enables the extension 64 to connect to the electrically insulated grounding plate 78, such that the extension 64 is basically connected to the housing 62. In one embodiment, the extension the threads 130 on an exterior surface at the proximal end 128 that engage the internal threads 124 on the second section 122 of the electrically insulated grounding plate 78. The extension 64 is hollow in the longitudinal direction and is sized and configured to enable electrical wiring to pass therethrough. The distal end 126 of the extension 64 also has threads 132 on an exterior surface which enables the extension 64 to couple to the sealed cap 82.

Figure 4C:
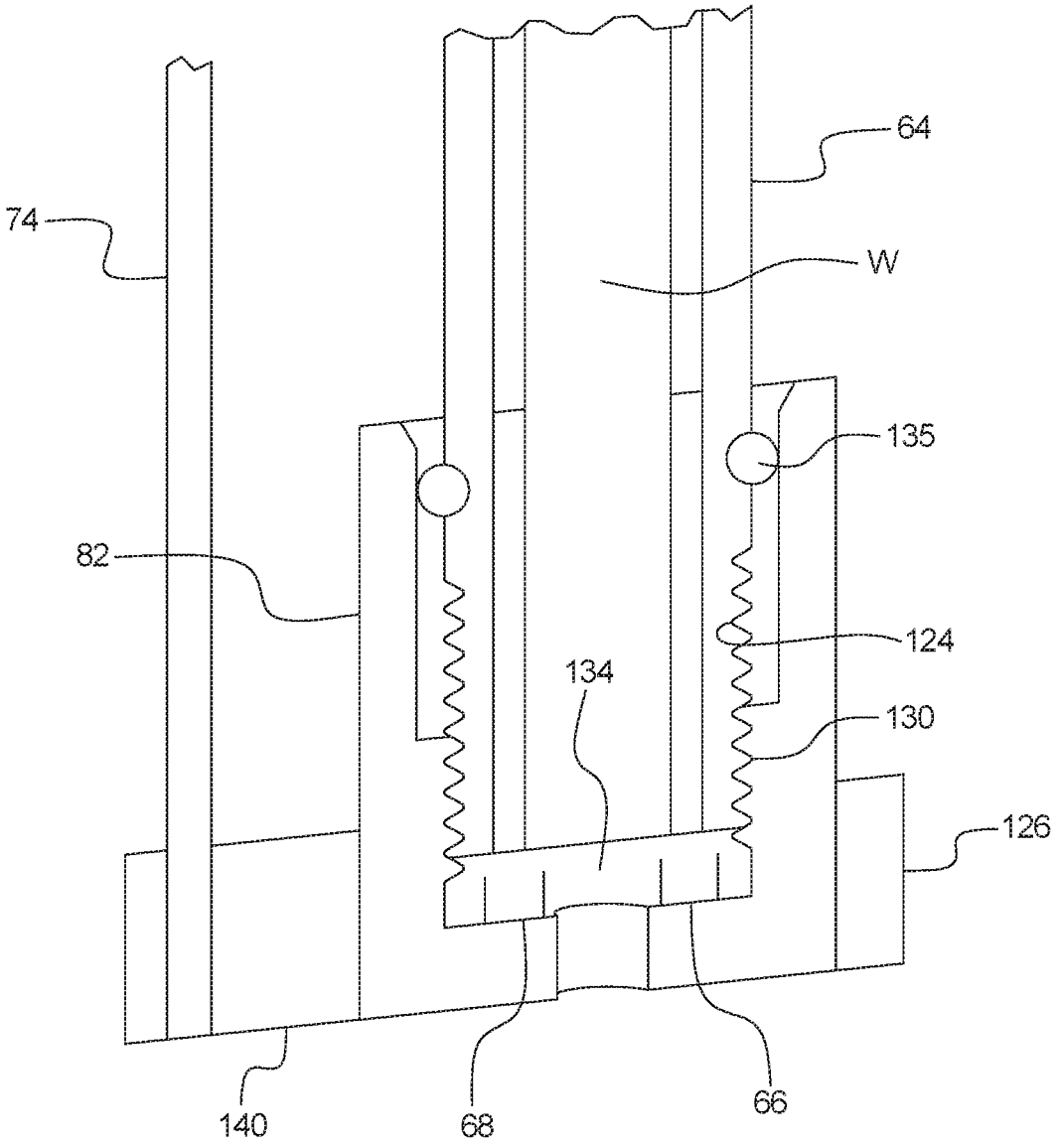
FIG. 4C is an enlarged view in section of the sealed cap of the seal support sensor.
Figure 5:
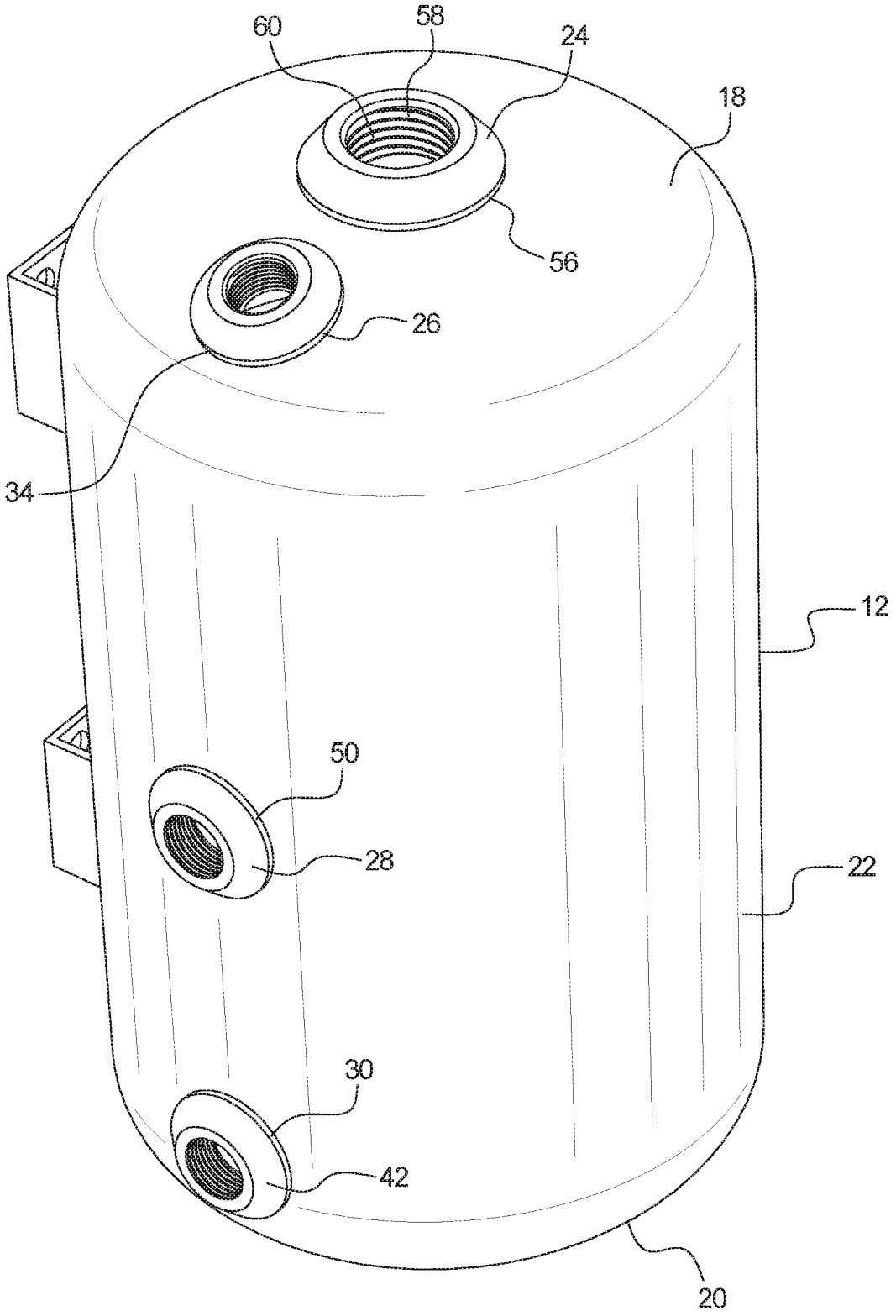
FIG. 5 is a top view of the barrier fluid tank with the seal support sensor of FIG. 2 removed.

As shown in FIGS. 4*a* and 4C, the sealed cap 82 is a cylindrical molded plastic member with internal threads that engage the threads on the exterior surface of the distal 128 end of the extension 64. Additionally, in one embodiment, a seal 135, such as an O-ring, is disposed within the sealed cap 82 to seal the sealed cap 82 from the elements. In one embodiment the seal 135 is a retardant polyurethane seal The sealed cap 82 has a hollow interior that is sized and configured to hold a sensor board 134.

The sensor board 134 can include a digital pressure transducer (first sensor 66) and temperature transducer (second sensor 68). The sealed cap 82 can hold the sensor board 134 in place and provides sealing for the digital pressure transducer 66 and an temperature transducer 68. Thus, the electrical wiring W can be connected to the control board 86 in the housing 62, pass through the adapter 102 and the electrically insulated grounding plate 78, through the extension 64 and the sealed cap 82 to the sensor board 134.

Turning back to the second longitudinal passage 108 in the adapter 102 in FIG. 4B, the second longitudinal passage 108 has a first section 136 and a second section 138, the second section 138 having a diameter $D_6$ that is larger than the diameter $D_7$ of the first section 136. The first longitudinal passage 106 is sized and configured to enable the capacitive level sensing probe 74 to pass therethrough adjacent to the extension 64 to a bracket 140 attached to the sealed cap 82. Thus, the capacitive level sensing probe 74 can be connected to the control board 86 in the housing 62, pass through the adapter 102 to the bracket 140 attached to the sealed cap 82.

Figure 6:
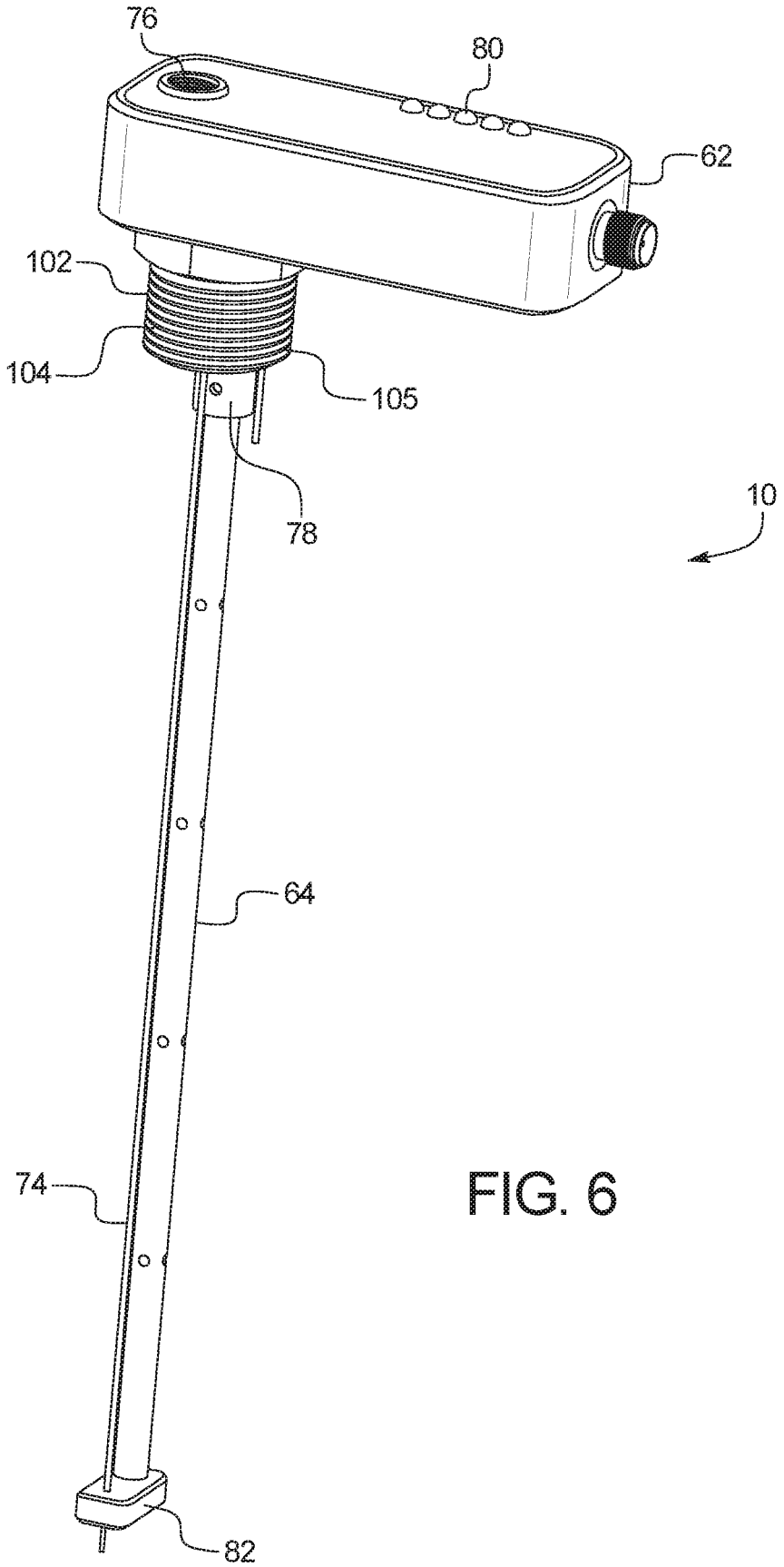
FIG. 6 is a side view of another embodiment of the seal support sensor of FIG. 2.
Figure 7:
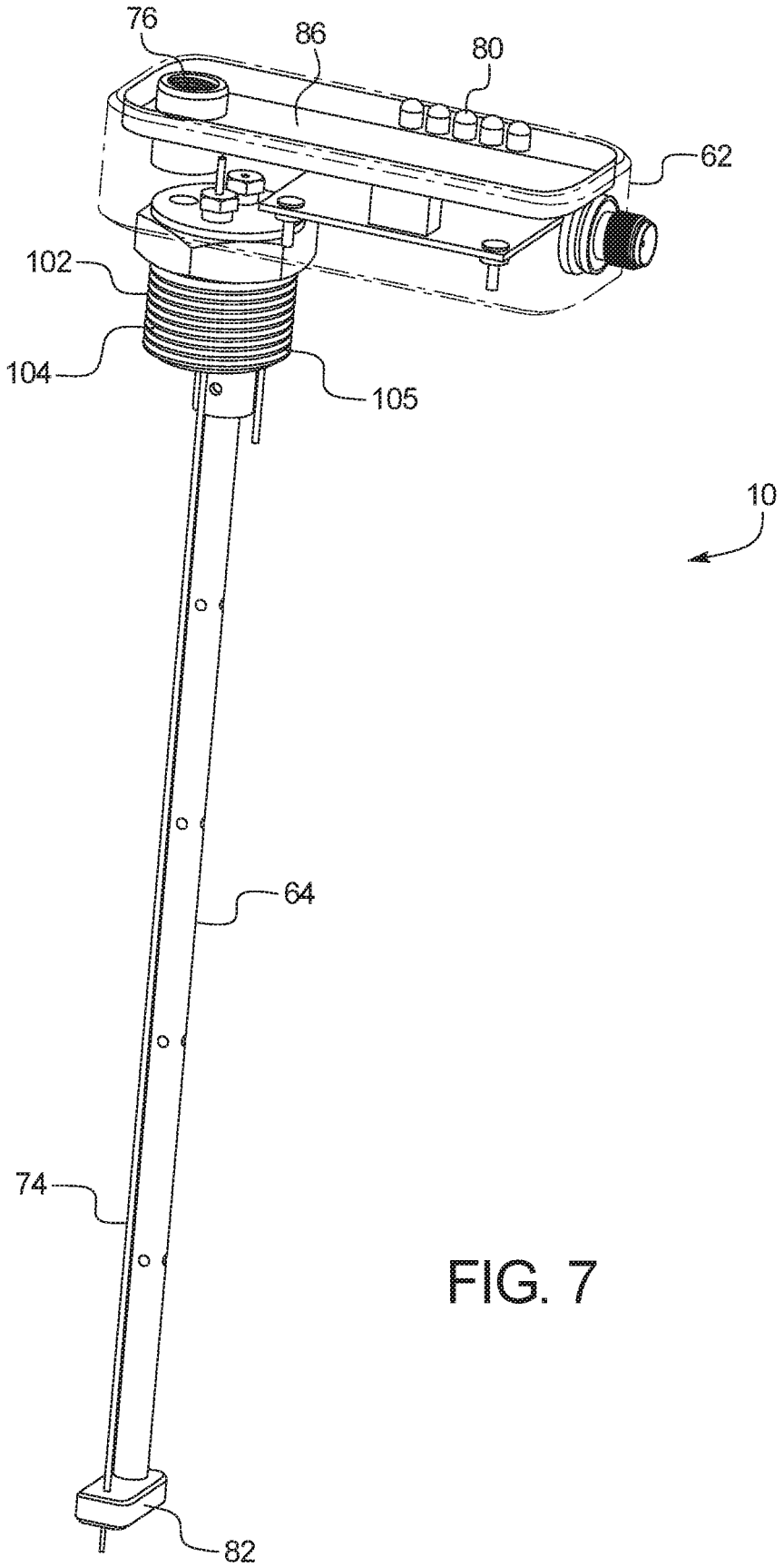
FIG. 7 is a side view of the seal support sensor of FIG. 6 with the housing in phantom.

As shown in FIGS. 6 and 7, the seal support sensor can have a housing with a rectangular housing 62. In this embodiment, the display, can be LEDs on the top surface of the housing. This embodiment is substantially similar in operation and internal structure as the embodiment illustrated in FIGS. 2-5.

Figure 8:
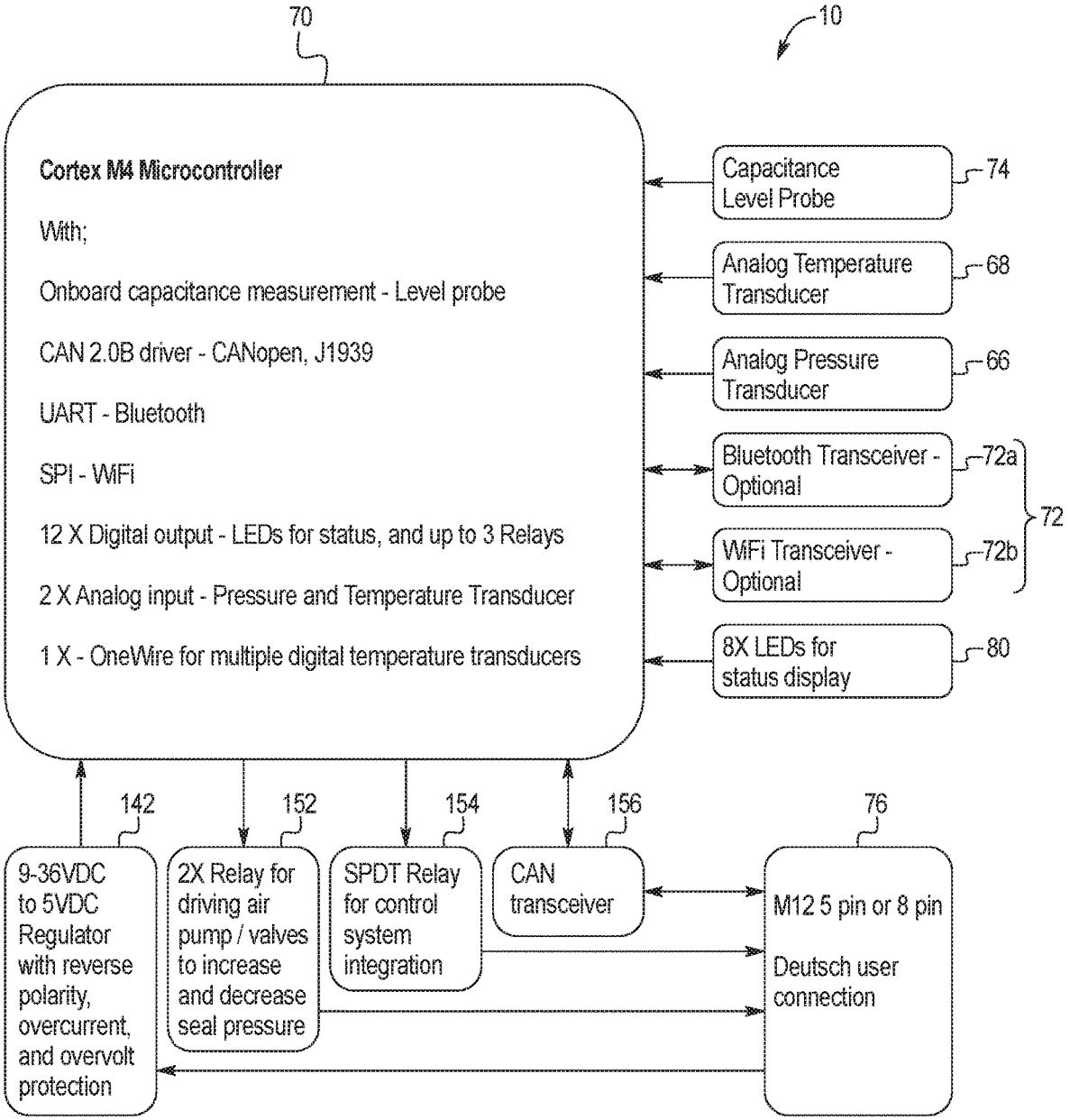
FIG. 8 is a schematic of the seal support sensor according to embodiments of the present invention.

As shown in FIG. 8, the electronic controller 70 can be a cortex M4 microcontroller 70 or any other controller 70 configured to carry out the processes discussed herein. For example, in one embodiment, the electronic controller 70 preferably includes a microcontroller or microcomputer with a control program that controls the seal support sensor 10 as discussed below. The electronic controller 70 can also include other conventional components such as an input interface circuit, an output interface circuit, and storage devices such as a ROM (Read Only Memory) device and a RAM (Random Access Memory) device. The microcomputer of the electronic controller 70 is programmed to control the seal support sensor 10. The memory circuit stores processing results and control programs such as ones for the seal support sensor 10 operation that are run by the processor circuit. The electronic controller 70 is operatively coupled to the first sensor 66, the second sensor 68, the wireless communication system 72, the capacitive level sensing probe 74, and the multi-pole connector 76 in a conventional manner. The internal RAM of the electronic controller 70 stores statuses of operational flags and various control data. The electronic controller 70 is capable of selectively controlling any of the components of the control system in accordance with the control program. It will be apparent to those skilled in the art from this disclosure that the precise structure and algorithms for the electronic controller 70 can be any combination of hardware and software that will carry out the functions of the present invention.

In one embodiment of the present invention, the electrical system can include the electronic controller 70 that is a Cortex M4 microcontroller. The electronic controller 70 is electrically connected to an onboard capacitance measurement—level probe, a CAN 2.0B driver—CANopen, J1939, a UART—Bluetooth, SPI—WIFI, 12XDigital output (for LEDS fir status and up to 3 relays), 2× Analog input (for the pressure and Temperature transducers, and 1×—one wire for multiple digital temperature transducers.

The controller 70 is in communication, the capacitive level sensing probe 74, the temperature transducer 68, the pressure transducer 66, the wireless communication system 72 (for example, the Bluetooth transceiver 72*a*, the WIFI transceiver 72*b*) and the display 80. Further the controller 70 is in communication with a regulator 142, relays 144 for driving air pumps/valves that are capable of increasing and decreasing seal pressure, an SPDT replay 146 for control system integration and a CAN transceiver 148. Each of these elements (the regulator 142, the relays 144 for driving air pumps/valves that are capable of increasing and decreasing seal pressure, the SPDT replay 146 for control system integration and the CAN transceiver 148) are in turn in electrical communication with the multi-pole connector 76.

As illustrated in FIG. 4A, the seal support sensor 10 can be inserted in the barrier fluid tank 12, which fluid F from the seal pump shaft seal 14 can be disposed. The extension 64 is disposed within the fluid F and the sensor (e.g., temperature transducer 68, the pressure transducer 66) can be disposed at the distal end of the extension 64, such that the sensor (e.g., temperature transducer 68, the pressure transducer 66) is disposed within the barrier fluid tank 12 and configured to detect a parameter within the barrier fluid tank 12. In one embodiment, the sensor is the digital pressure transducer 66 in conjunction with a temperature transducer 68. In this embodiment, the capacitive level sensing probe 74 is an insulated spring steel rod or a corrosion resistant spring steel or, and also extends in to the fluid F.

Figure 9:
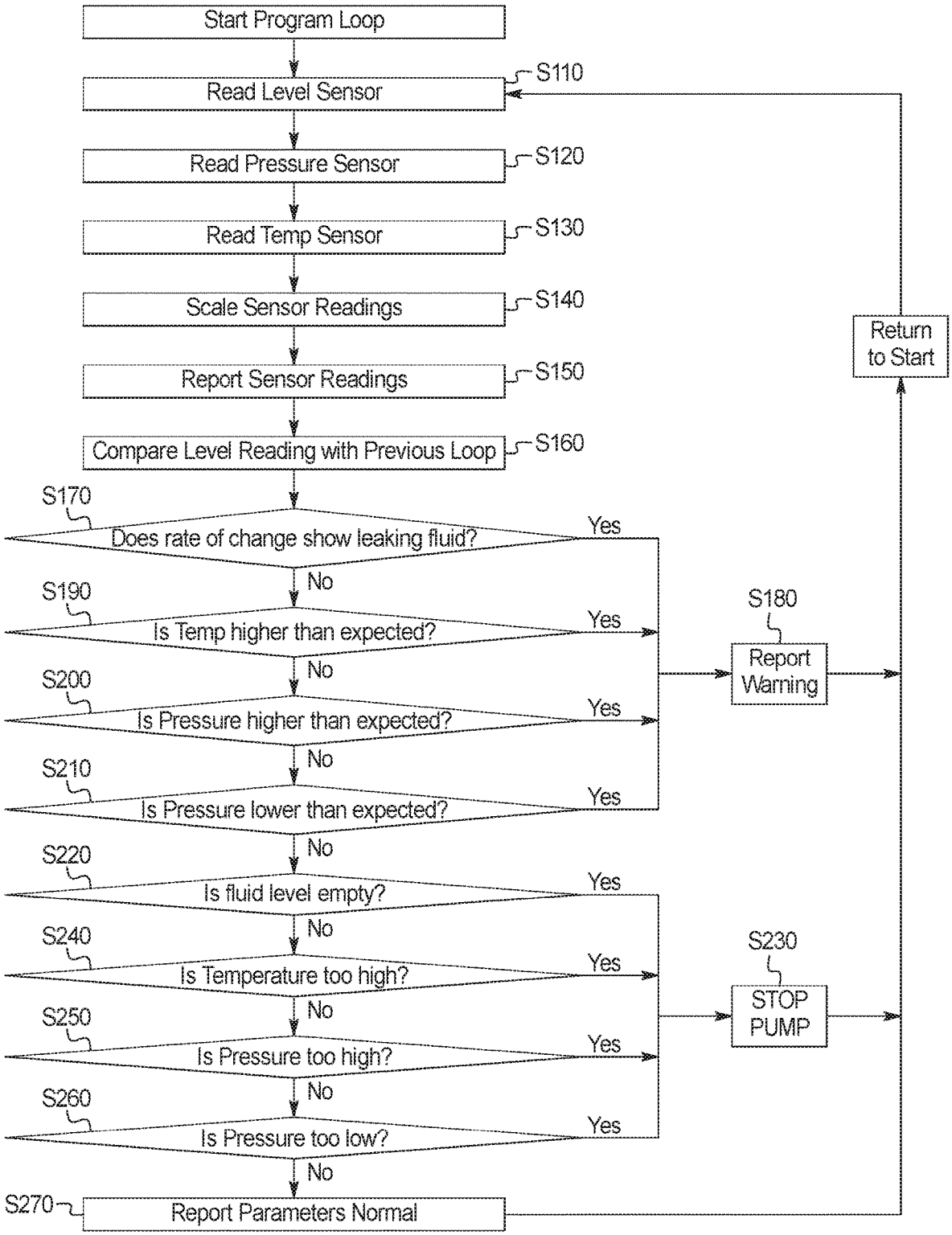
FIG. 9 is a flow chart illustrating the operation of the seal support sensor of FIG. 2.

Turning to FIG. 9, the process of operating the seal support sensor is illustrated. First, the controller 70 on the control board 86 reads the capacitive level sensing probe 74 (i.e., the level sensor) in step S110, reads the pressure transducer 66 in step S120, and reads the temperature transducer 68 in step S130.

In step S140, the controller 70 scales the sensor readings from at least one of steps S110-S130, and then reports the sensor readings to the controller 70 in step S150. The controller 70 in step S160 can compare the sensor readings to previously stored (in a storage device) sensor readings. The previously stored readings can be readings from readings previously detected or from a predetermined set of values or parameters. Thus, in one embodiment, the sensor readings are parameters that are compared to previous parameters or readings. In one embodiment, the parameters are compared to a predetermined parameter range. In step S170, the parameter can be a rate of change of the level of the fluid F (e.g., as determined by the sensed level compared to a previous sensed level). If the controller 70 determines that there is a change of level via the capacitive level sensing probe 74, such that the rate of change shows a leaking fluid, the controller 70 can determine that a mitigation operation should be performed. In step S180, the mitigation operation can be a warning that is reported. The warning can be a visual display 80 through LEDs on the display 80. Moreover, the warning can be an audible warning, or a warning that is displayed on the test equipment through the multi-pole connector 76, or any combination thereof. The test sequence can then return to start.

If the controller 70 determines that the level of the fluid F does not show a leaking fluid the controller 70 can compare the sensed temperature with a previously sensed temperature (or a predetermined temperature) stored in the storage device in step S190. If the controller 70 determines that there is a change in temperature or the temperature is higher than a threshold (or predetermined temperature), the controller 70 can determine that a mitigation operation should be performed. In step S180, the mitigation operation can be a warning that is reported. The warning can be a visual display through LEDs on the display 80. Moreover, the warning can be an audible warning, or a warning that is displayed on the test equipment through the multi-pole connector 76, or any combination thereof. The test sequence can then return to start.

If the controller 70 determines that the temperature of the fluid F does not show a change in temperature or the temperature is higher than a threshold (or predetermined temperature), the controller 70 can compare the sensed pressure with a previously sensed pressure (or a predetermined pressure) stored in the storage device in step S200. If the controller 70 determines that there is a change in pressure or the pressure is higher than a threshold (or predetermined pressure), the controller 70 can determine that a mitigation operation should be performed. In step S180, the mitigation operation can be a warning that is reported. The warning can be a visual display through LEDs on the display 80. Moreover, the warning can be an audible warning, or a warning that is displayed on the test equipment through the multi-pole connector 76, or any combination thereof. The test sequence can then return to start.

If the controller 70 determines that the pressure of the fluid F does not show a pressure that is higher than a threshold (or predetermined) temperature, the controller 70 can compare the sensed pressure with a previously sensed pressure (or a predetermined pressure) stored in the storage device in step S210. In one embodiment, the pressure can be compared with the environmental pressure sensed by an environmental pressure sensor. If the controller 70 determines that there is a change in pressure or the pressure is lower than a threshold (or predetermined pressure), the controller 70 can determine that a mitigation operation should be performed. In step S180, the mitigation operation can be a warning that is reported. The warning can be a visual display through LEDs on the display 80. Moreover, the warning can be an audible warning, or a warning that is displayed on the test equipment through the multi-pole connector 76, or any combination thereof. The test sequence can then return to start.

If the controller 70 determines that the pressure of the fluid F does not show a pressure that is lower than a threshold (or predetermined) temperature, the controller 70 can determine whether the fluid level is empty in step S220. The controller 70 can determine that the fluid level is empty based on the level of the fluid sensed using the via the level sensor. If the fluid F is level is not empty, the controller 70 can determine that a mitigation operation should be performed. In step S240, the mitigation operation can be a stopping the pump. In addition, the mitigation operation can include a visual display through LEDs on the display 80. Moreover, the warning can include an audible warning, or a warning that is displayed on the test equipment through the multi-pole connector 76, or any combination thereof. The test sequence can then return to start.

If the controller 70 determines that fluid level is not empty, in step S250, the controller 70 can compare the sensed temperature with a threshold temperature (or a predetermined) temperature stored in the storage device in step S190. If the controller 70 determines that the temperature is higher than the threshold (or predetermined) temperature, the controller 70 can determine that a mitigation operation should be performed. In step S240, the mitigation operation can be a stopping the pump. In addition, the mitigation operation can include a visual display through LEDs on the display 80. Moreover, the warning can include an audible warning, or a warning that is displayed on the test equipment through the multi-pole connector 76, or any combination thereof. The test sequence can then return to start.

If the controller 70 determines that fluid temperature is not higher than the threshold (or predetermined) temperature, in step S250, the controller 70 can compare the sensed pressure with a threshold pressure (or a predetermined pressure) stored in the storage device in step S260. If the controller 70 determines that the pressure is higher than the threshold pressure (or predetermined pressure), the controller 70 can determine that a mitigation operation should be performed. In step S240, the mitigation operation can be a stopping the pump. In addition, the mitigation operation can include a visual display through LEDs on the display 80. Moreover, the warning can include an audible warning, or a warning that is displayed on the test equipment through the multi-pole connector 76, or any combination thereof. The test sequence can then return to start.

If the controller 70 determines that fluid pressure is not higher than the threshold (or predetermined) temperature, in step S260, the controller 70 can compare the sensed pressure with a threshold pressure (or a predetermined pressure) stored in the storage device in step S270. If the controller 70 determines that the pressure is lower than the threshold pressure (or predetermined pressure), the controller 70 can determine that a mitigation operation should be performed. In step S240, the mitigation operation can be a stopping the pump. In addition, the mitigation operation can include a visual display through LEDs on the display 80. Moreover, the warning can include an audible warning, or a warning that is displayed on the test equipment through the multi-pole connector 76, or any combination thereof. The test sequence can then return to start.

If the controller 70 determines that fluid pressure is not lower than the threshold (or predetermined) temperature, in step S270, the controller 70 can report the parameters are normal in step S280. The report can be on a visual display through LEDs on the display 80. Moreover, the can be displayed on the test equipment through the multi-pole connector 76, or any combination thereof. The test sequence can then return to start.

Thus, as can be understood, the controller 70 is configured to determine whether a parameter within the barrier fluid tank 12 is within a predetermined range (i.e., level, pressure, and/or temperature range) and perform a mitigation operation when the parameter is not within the predetermined range. The controller 70 is also configured to wirelessly display the mitigation operation as a warning or information through the wireless communication system 72, such as the WIFI transceiver 72*b* or Bluetooth transceiver 72*a* to a remote display. Moreover, instructions can be issued through the same wireless (or wired) connection. For example, instructions such as a pump shut down can be communicated to the controller 70 through the wireless communication system 72 or a wired connection.

As shown in FIG. 8, the controller 70 can also be connected to the regulator 142 with reverse polarity, overcurrent and overvolt protection 150, the relay 152 for driving pump valves to increase and decrease the seal pressure, and a relay 154 for system integration into existing pump control applications. Thus, in some embodiments, the controller 70 can perform a mitigation operation by changing the pump seal pressure and/or controlling and regulating the fluid temperature.

Thus, the seal support sensor 10 can perform continuous variable level measurement, perform temperature compensation enable readings for the seal support pressure. Embodiments of the present invention can include a modular fieldbus transceiver 156 for full monitoring and control including CANbus, UART, Bluetooth and WiFi. Further, the controller 70 can operate in conjunction with a sensors system that can communicate with additional pump sensors over field bus transceiver for additional versatility, i.e., a pump shaft RPM and torque sensor, seal and bearing temperature sensors, and hydraulic pressure transducers or current transformers for hydraulic or electric load As can be understood, the sensors as described herein can be low-pass filtered with 1-second running average. A CANbus, or the WiFi transceiver 72*b* or the Bluetooth transceiver 72*a* can used for sensor reading and calibration/setup. The relay provides dry contacts for use of N.O. or N.C. contacts. Power input and relay contacts with WiFi or Bluetooth can use a 5-pole connector. The CANbus with Power and Relay Contacts, or additional relay contacts, can use an 8-pole connector option. The controller 70 housing 62 is encapsulated/potted with non-shrink electronics potting, or optional with IP69 removable cover for serviceability. The CANbus can be used to read in additional pump sensors.

The present invention is capable of precise control and monitoring of barrier fluid environmental factors. Thus, the life of the seal can be extended, and failures and undue wear can be prevented.

The sensors are conventional components that are well known in the art. Since sensors are well known in the art, these structures will not be discussed or illustrated in detail herein. Rather, it will be apparent to those skilled in the art from this disclosure that the components can be any type of structure and/or programming that can be used to carry out the present invention.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "member" or "element" when used in the singular can have the dual meaning of a single part or a plurality of parts.

The terms "sense" and "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A seal support sensor, comprising:

a housing attached to an external portion of a barrier fluid tank for a pump;

an extension having a distal and a proximal end, the proximal end being connected to the housing;

an electronic controller disposed within the housing and configured to determine whether a parameter within the barrier fluid tank is within a predetermined range, when the parameter is not within the predetermined range, the controller determines that a shut down of the pump is required and is configured to send a signal shutting down the pump based on the parameter detected within the barrier fluid tank;

a capacitive level sensing probe configured to produce a level probe signal, the capacitive level sensing probe being an insulated spring steel rod coupled to a bracket at the distal end of the extension; and a pressure transducer configured to detect a pressure within the barrier fluid tank, the pressure transducer disposed entirely within a sealed cap at the distal end of the extension, the sealed cap including a seal configured to seal the cap from external elements.

2. The seal support sensor according to claim 1, further comprising a display configured to display a warning.

3. The seal support sensor according to claim 1, further comprising a wireless communication system configured to issue a warning.

4. The seal support sensor according to claim 1, further comprising a temperature sensor disposed at the distal end, configured to be disposed within the barrier fluid tank and configured to detect a temperature within the barrier fluid tank and produce a temperature signal based on the detected temperature.

5. The seal support sensor according to claim 4, wherein the level probe is compensated by the temperature signal.

6. The seal support sensor according to claim 1, wherein the electronic controller is configured to analyze the pressure detected within the barrier seal fluid tank and compare the pressure with a pressure detected by an environmental pressure sensor.

7. The seal support sensor according to claim 1, further comprising a multi-pole connector attached to the housing and configured to enable connection to test equipment.

8. The seal support sensor according to claim 1, wherein the housing attaches to the barrier fluid tank by a pressure fitting adapter.

9. The seal support sensor according to claim 8, further comprising an electrically insulated grounding plate connected to the pressure fitting adapter and attached to the extension.

10. The seal support sensor according to claim 1, further comprising sensor disposed entirely within the sealed cap.

11. The seal support sensor according to claim 1, wherein the capacitive level sensing probe is low-pass filtered with a one-second running average.

12. The seal support sensor according to claim 10, wherein the sensor is a temperature transducer.

* * * * *